US007455166B2

(12) United States Patent
Seiffert et al.

(10) Patent No.: US 7,455,166 B2
(45) Date of Patent: Nov. 25, 2008

(54) SUPPLY TUBE FOR TABLETS

(75) Inventors: Martin Seiffert, Schelklingen (DE); Harald Litke, Achstetten (DE)

(73) Assignee: Uhlmann Pac-Systeme GmbH & Co. KG (DE)

( * ) Notice: Subject to any disclaimer, the term of this patent is extended or adjusted under 35 U.S.C. 154(b) by 0 days.

(21) Appl. No.: 11/365,283

(22) Filed: Mar. 1, 2006

(65) Prior Publication Data

US 2006/0201774 A1 Sep. 14, 2006

(30) Foreign Application Priority Data

Mar. 2, 2005 (EP) ..... 05004560

(51) Int. Cl.
*B65G 47/24* (2006.01)

(52) U.S. Cl. ..... 193/46; 193/44

(58) Field of Classification Search ..... 193/46, 193/44; 221/173, 175, 25; 198/390, 396, 198/406; 453/61, 62; 194/344
See application file for complete search history.

(56) References Cited

U.S. PATENT DOCUMENTS 2,886,157 A 5/1959 Hall
3,797,641 A * 3/1974 Nelson et al. ..... 193/46
4,805,789 A * 2/1989 Lancesseur et al. ..... 215/6
4,938,372 A 7/1990 Morimoto et al.
5,909,822 A * 6/1999 George et al. ..... 221/25
6,032,783 A * 3/2000 Saito et al. ..... 198/390
2003/0072459 A1 * 4/2003 Cole et al. ..... 381/71.7
2004/0035878 A1 * 2/2004 Aylward ..... 221/303

FOREIGN PATENT DOCUMENTS

JP 2003-237921 A 8/2003
WO WO 2004/089756 A 10/2004

* cited by examiner

*Primary Examiner*—Gene O. Crawford
*Assistant Examiner*—Ramya G Prakasam
(74) *Attorney, Agent, or Firm*—Jansson Shupe & Munger Ltd.

(57) ABSTRACT

A supply tube has a conveying channel of a substantially rectangular cross-section formed therein for successively supplying tablets, pills, capsules, dragées and similar products from a reservoir under the effect of gravity to a receptacle. The conveying channel has several successively arranged sections adjoining one another, wherein successive sections are inclined alternately in different directions with respect to a longitudinal plane of the supply tube thereby enclosing an angle of less than 45° with the longitudinal plane, and wherein the cross-section of the successive sections is distorted by an angle of up to about 90° around the longitudinal plane.

6 Claims, 3 Drawing Sheets

Fig. 1
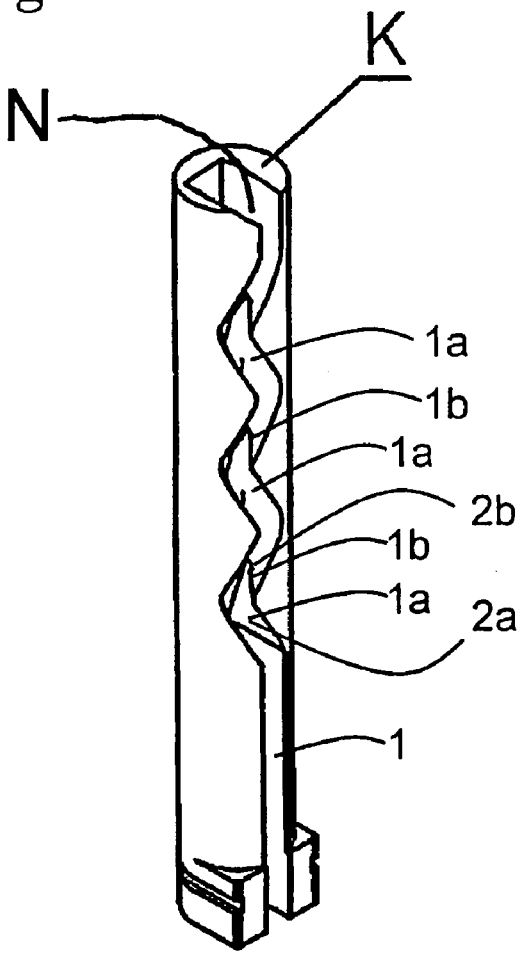
Fig. 2
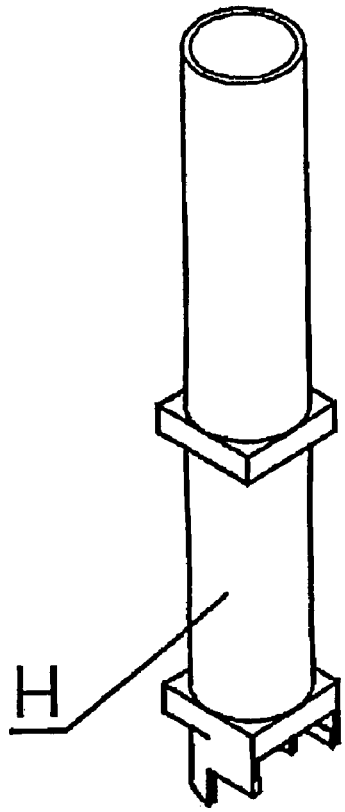
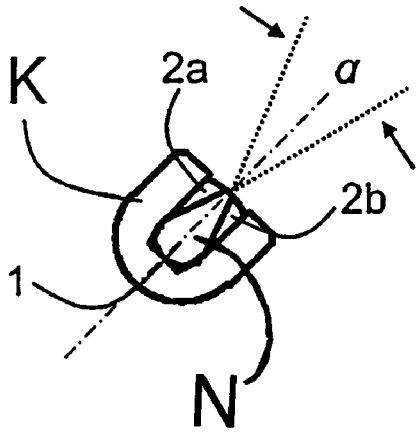
Fig. 3

SUPPLY TUBE FOR TABLETS

CROSS REFERENCE TO RELATED APPLICATIONS

This application claims the benefit of EP 05 004 560.8, filed on Mar. 2, 2005, the contents of which are incorporated herein.

FIELD OF THE INVENTION

The present invention relates to a supply tube for supplying tablets, pills, capsules, dragées and similar products under the effect of gravity from a reservoir to a receptacle, through a substantially rectangular cross-section channel formed in the supply tube.

BACKGROUND OF THE INVENTION

Pharmaceutical products, as for instance tablets, capsules, pills, suppositories, dragées etc. are typically packed in bottles, bags, blisters, folding boxes and similar containers. Blisters have a plastics sheet in which a plurality of deep-drawn cups is formed, each being filled with pills and being collectively sealed by a cover sheet. The filling of pills or tablets into the packages, particularly into blisters, is carried out by automatically operating machines, which are capable of inserting the respective products accurately and precisely at high speed. Conventional packaging machines include for this purpose several supply tubes and grooves which convey the pills or tablets from a reservoir in the direction towards their receptacles. A precise alignment and introduction of pills may be critical, particularly for pills being inserted into the cups of a blister.

When supplying the pills through supply tubes in which they fall downwards caused by the effect of gravity, the pills might get stuck if, caused by the required dosage conditions, the pills come to a stop and partially overlap so that they stand up obliquely. One therefore speaks of a "shingling" of the pills.

US 2004/0035878, incorporated herein by reference in its entirety, discloses a supply tube that reduces the above-mentioned shingling. The supply tube has a helically extending channel that extends between the inlet end and the outlet end of the tube. This helical channel has a substantially rectangular cross-section that is larger than the cross-section of the pills to be conveyed. "Substantially rectangular" in this case means a cross-section where the largest extension of a first side of the rectangle in a first direction is larger than the largest extension of a second side in a second direction perpendicular to the first direction but where both sides do not necessarily have to be straight but may also be adapted to the cross-sectional shape of the tablets, pills and similar products to be conveyed through. This definition also applies to the present invention. When the pills fall through the above-cited helical channel, the pills perform a rotation due to the shape of the channel, but they do not rotate with respect to the channel. Within the channel the pills have a limited mobility with respect to the channel walls. This mobility reduces or prevents the jamming of the pills in the channel caused by shingling.

Relatively complex tools and molds are required for manufacturing a supply tube of the above-mentioned kind. It is an object of the present invention to provide a supply tube that prevents jamming of the products conveyed therein as a result of shingling and which can be manufactured in a simple manner.

SUMMARY OF THE INVENTION

A conveying channel in the supply tube has sections, which are basically formed as sections of a thread. Such have opposing inclination directions in successive sections. When falling through the conveying channel caused by the effect of gravity, the tablets, pills, capsules, dragées and similar products, hereinafter referred to as "pills" or as "pharmaceutical products," perform a dual-lurching movement. From a radial perspective, successive sections of the conveying channel are inclined alternately in different directions with respect to a longitudinal plane of the supply tube thereby enclosing an angle of less than 45° with the longitudinal plane, and from an axial perspective the cross-sections of respective ones of the successive sections are distorted with respect to one another by an angle of up to about 90° around the longitudinal plane.

The reversal of the lurching movement takes place at the transition points between successive channel sections, with the consequence that successive pills inevitably move relative to one another. The individual pills move in a dual-lurching manner when they pass through the supply tube. Thus, a jamming of successive pills as a result of the shingling effect is avoided even if the movement of the pills through the supply channel is interrupted, for example due to dosage conditions.

The movement course of the pills in the conveying channel in the supply tube therefore fundamentally differs from the one that is shown in the mentioned US 2004/0035878, since there the pills may fundamentally keep their position with respect to each other.

In addition to the safety against a jamming of the pills caused by the effect of shingling, the claimed invention has the advantage over the prior art that the supply tube can be manufactured in a very simple manner, for example either by machining a massive component or by an injection molding process.

In a preferred embodiment of the invention, the supply tube includes a core body with a groove having sections extending in an inclined direction with respect to the longitudinal plane of the core body, the sections having opposite inclination directions at successive sections, and a cladding tube which surrounds the core body and which laterally closes the groove for forming a conveying channel.

The groove may be machined in the core body by a method including the following steps: providing a longitudinal massive rod, a longitudinal rotating end mill and a longitudinal cladding tube; penetrating the rod with the rotating end mill in a radial direction, thereby forming a groove in the rod which is in parallel to a central longitudinal plane of the rod; moving the rod and the rotating end mill against each other in a longitudinal direction of the rod while rotating the rod in sections back and forth about up to 90° around the longitudinal plane; and, enveloping the rod with the cladding tube. The rotation of the core body may be up to approximately 90°. The end mill thereby leaves a groove in the core body, which, depending on the control of the movement courses on the surface of the core body, extends more or less wavelike or in a zigzag course. To obtain relatively sharp edges in the case of a zigzag-shaped course, an end mill with a respectively small diameter may be used. In such a case, however, multiple milling processes are carried out with mutual offset of the individual milling grooves with respect to the core body.

Thus, complex molds do not have to be built for this manufacturing process. Only a machine control program of the simple kind is required which is input, for example, into a program-controlled milling machine.

A manufacture using injection molding technology is also simple. A supply tube manufacturing by injection molding may be performed by creating two half-shells, which are then joined at a joint face extending in the longitudinal direction of the supply tube and which each comprise a groove that forms a partial cross-section of the conveying channel.

As a result of implementing the present invention, the above-noted objects are met, and various advantageous embodiments of the invention are achieved, including methods of manufacturing a supply tube.

This summary does not limit the invention, which is defined only by the claims. The invention will now be explained in detail with reference to exemplary embodiments shown in the drawings.

BRIEF DESCRIPTION OF THE DRAWING FIGURES

FIG. 1 shows the core body of a two-piece supply tube.

FIG. 2 shows a cladding tube adapted for accommodating the core body of FIG. 1.

FIG. 3 is a top view of the core body of FIG. 1.

DETAILED DESCRIPTION OF PREFERRED EMBODIMENTS

Figure 4:
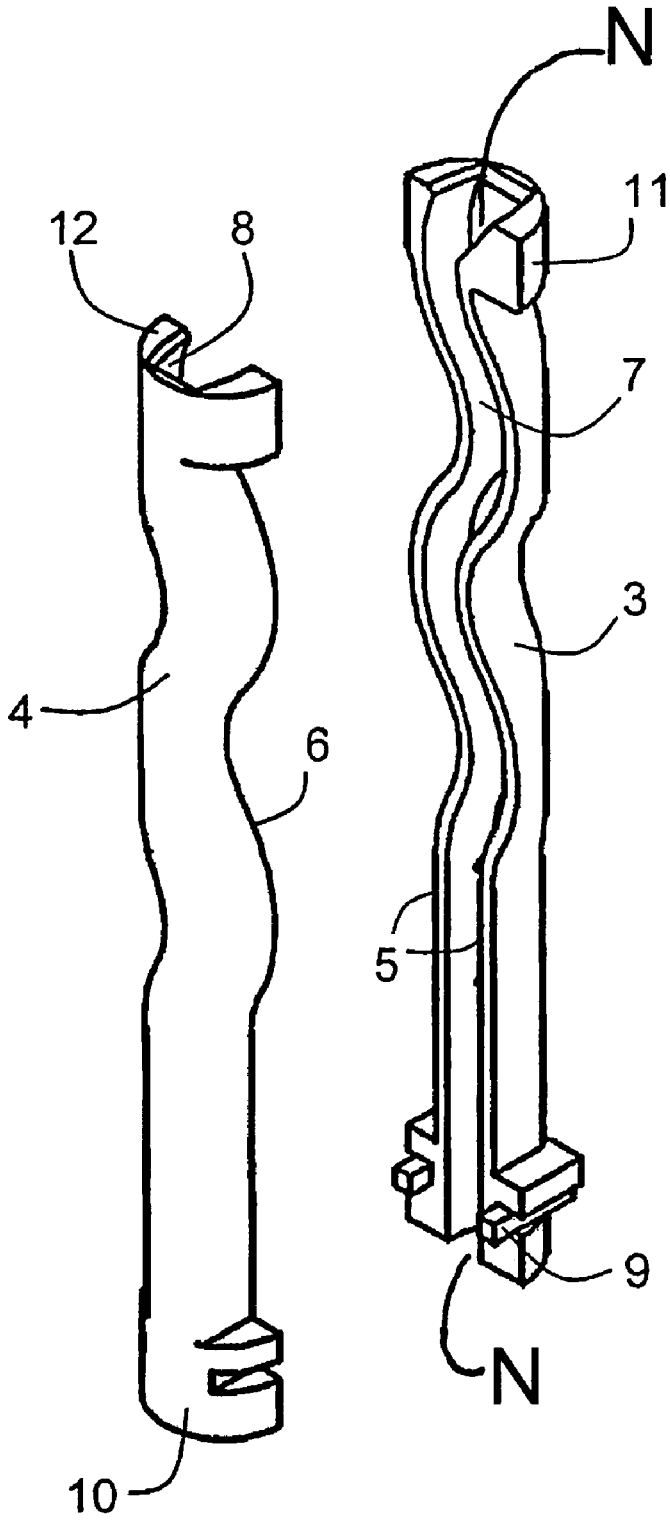
FIG. 4 shows two matching shells of a two-piece supply tube according to an alternative embodiment.

FIGS. 1-3 show the two portions of a supply tube, FIGS. 1 and 3 showing a core body K of circular cross-section provided with a substantially longitudinal groove N, and FIG. 2 showing a cladding tube H adapted for accommodating the core body K.

The groove N formed in the core body K substantially extends along and on both sides of a central longitudinal plane. It reveals a straight section 1 in the lower part of the core body K, and sections 1*a* and 1*b* in the upper portion of the core body K which are alternately inclined towards the longitudinal plane, thereby enclosing an angle with the longitudinal plane from a radial perspective. In the present example, this angle is approximately 30° so that two adjacent sections 1*a* and 1*b* enclose an angle of approximately 120°. In the radial perspective, the groove N in the core body K extends in the partial portion determined by sections 1*a* and 1*b* in a zigzag shape on both sides of a the longitudinal plane which is defined by the straight section 1.

In an axial perspective, the sections 1*a* and 1*b* have cross-sections, which are distorted against each other in alternate directions, wherein the angle of distortion is determined by the inclination of the groove sections 1*a* and 1*b* with respect to the longitudinal plane. This is the result of a preferred type of manufacture, according to which the longitudinal core body K, having a circular cross-section, is moved along a longitudinal rotating end mill in a longitudinal direction of the core body while the core body is rotated in sections back and forth about up to 90° around the longitudinal plane. In the example shown, this distortion is approximately ±20°, which is shown by the angle α in FIG. 3. In the area of the groove sections 1*a* and 1*b*, the groove N is therefore not only defined by a two-dimensioned wave or zigzag line but also has a third, namely a rotary, component, which results from the fact that the end mill is kept stationary during rotation and translational displacement of the core body.

This produces a conveying channel, in which a product conveyed through it, for instance a pill, not only performs a see-saw movement but also a lurching movement in which the pill oscillates around two axes perpendicular to one another. The angle of rotation α, about which the core body K is rotated during the milling process around its longitudinal plane, can well be seen in FIG. 3.

It can be seen in FIG. 3 that the channel is in partial areas thereof restricted by inclined wall sections 2*a* and 2*b*. In the top view onto the core body K, which is shown in FIG. 3, the first inclined wall section 2*a*, which belongs to the groove section 1*a*, can be seen, followed by the inclined wall section 2*b* arranged in offset fashion behind the groove section 1*a*, the wall section 2*b* belonging to the following groove section 1*b* which has a inclination in a direction opposite to the first groove section 1*a*.

The inclination of the groove sections 1*a* and 1*b*, with respect to the longitudinal plane in a radial view, is determined by the ratio of the angle of rotation α and the speed of the translational displacement of the core body during manufacturing. The inclination must be sufficiently large, so that, at the transition points from the channel section having the one inclination direction to the channel section having the other inclination direction, a smooth passage of the pills through the conveying channel is ensured. In the case of a zigzag-like extending groove, the inclination should be selected so that the angle enclosed by two successive groove sections 1*a* and 1*b* is obtuse. In the example shown, the overall angle of rotation α°is approximately 40°. Accordingly, when producing the groove sections 1*a* and 1*b*, the core body K in the present example is rotated about up to 20° in the one and the other direction with respect to the longitudinal plane, i.e. the position that it has when milling the axially extending groove section 1.

The cladding tube H shown in FIG. 2 is in the assembled state of the supply tube. The cladding tube H is slid over the core body K to laterally close the groove N and to thereby complete the conveying channel so that the products conveyed through the groove N cannot escape from the supply tube in an uncontrolled manner. One of ordinary skill in the art will appreciate other details that may be included in the cladding tube H, which does not have to be explained in more detail.

The core body K may be made of any suitable material which has a sufficient stability, e.g., aluminum or plastics, possibly of glass fiber reinforced plastics. The same applies to the cladding tube H.

FIG. 4 shows a second embodiment of a supply tube according to the invention. This tube consists of two matching shells 3 and 4, which are determined to be joined at their joint faces 5 and 6. Both shells 3 and 4 have grooves 7 and 8, which in the joined state of the shells 3 and 4 form a conveying channel. The course of the grooves is not zigzag-shaped like the groove N in the example of FIG. 1, but it is wavelike. At its lower end the one shell 3 has a plug portion 9, whereas the other shell 4 has a matching receptacle portion 10. At their upper ends the shells 3 and 4 are provided with half-flanges 11 and 12, which in the joined state form a circular contour and are suitable to be inserted into a respective receptacle of a circular cross-section, for instance an outlet opening of a reservoir.

Since in the embodiment according to FIG. 4 the conveying channel formed by the two grooves 7 and 8 has a course wound in alternating directions, pills moving through this conveying channel perform dual-lurching movements when passing through the channel in which the pills oscillate about two axes that are perpendicular with respect to one another. This movement course prevents successive pills from shingling and getting jammed.

Figure 5:
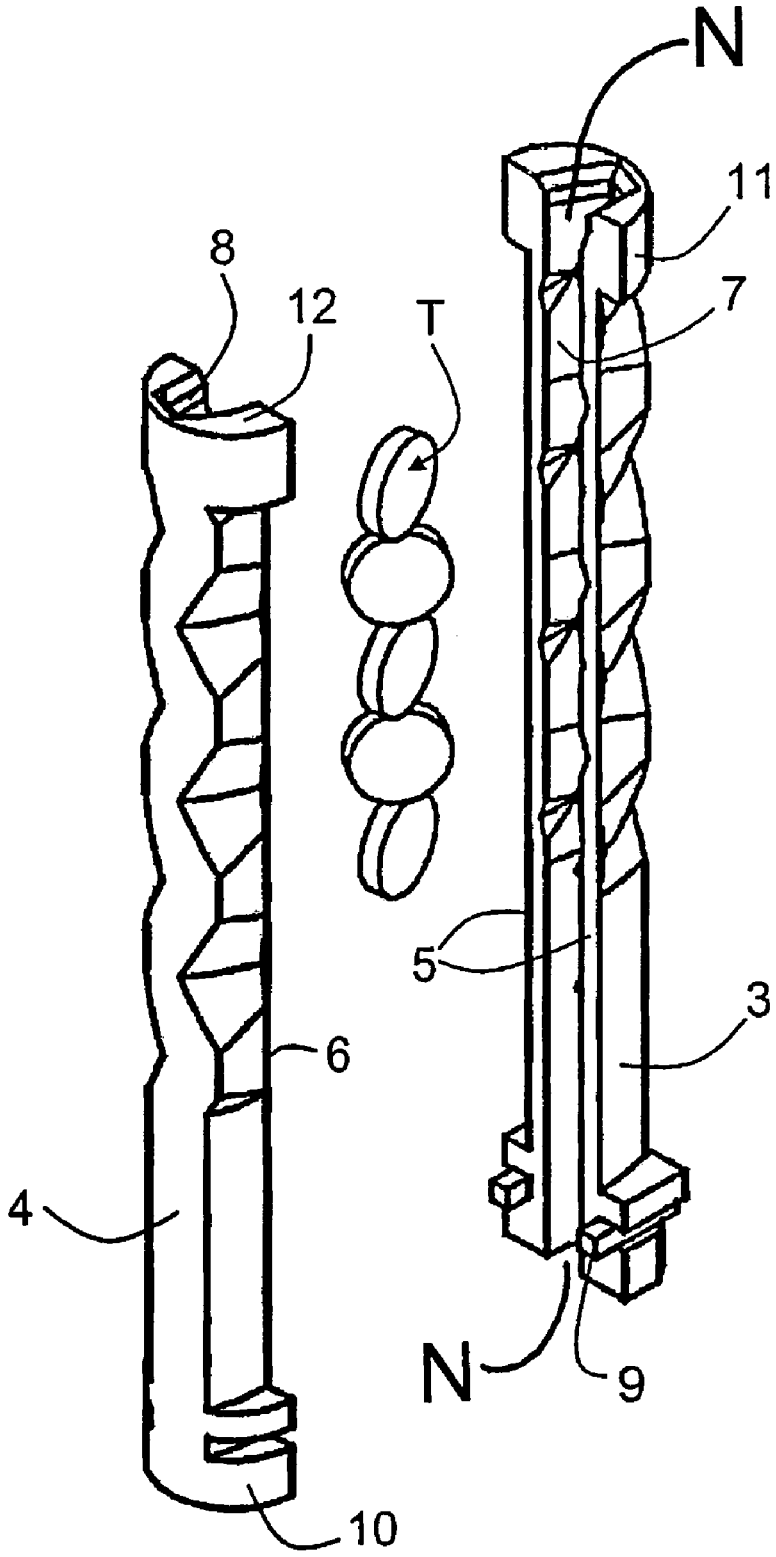
FIG. 5 shows two matching shells of a two-piece supply tube according to another alternative embodiment and a number of tablets in successive positions that they take when passing through the conveying channel in a supply tube formed by the two shells.

FIG. 5 shows another alternative embodiment of a supply tube according to the invention. Such supply tube has two matching shells 3 and 4, which are determined to be joined at joint faces 5 and 6. In this embodiment, the grooves 7 and 8 in the shells 3 and 4 are formed such that the conveying channel formed by the joining of the shells 3 and 4 has a course that is similar to the one that is realized in the embodiment according to FIG. 1. Contrary to FIG. 1, the conveying channel is, however, arranged concentrically in the supply tube formed by the joined shells 3 and 4.

In the illustrated example, FIG. 5 shows a temporary position of five tablets T that the tablets T assume with respect to each other when they pass through the conveying channel of the embodiment of FIG. 5. In the positions shown, the individual tablets T are distorted against each other, which is effected by the course of the conveying channel. In a subsequent phase (not shown), all tablets must rotate in the position that was taken by the previous tablet. The tablets T must therefore rotate with respect to each other on their edges, which prevents the shingling described above.

The shells 3 and 4 shown in FIGS. 4 and 5 can be manufactured by injection molding. For this purpose, slide-less injection molds can be used, which may require a proper selection of the position and the course of the joint faces 5 and 6.

The supply tubes according to the invention may be inserted in an automated filling or dispensing apparatus as is described in the above-mentioned US 2004/0035878 without further modifications having to be made on such apparatus. Regarding additional applications, particularly with respect to the dosing mentioned, reference is again made to US 2004/0035878.

While the principles of the invention have been shown and described in connection with specific embodiments, it is to be understood that such embodiments are by way of example and are not limiting. Consequently, variations and modifications commensurate with the above teachings, and with the skill and knowledge of the relevant art, are within the scope of the present invention. The embodiments described herein are intended to illustrate best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A supply tube for successively transferring, under the effect of gravity, ones of a plurality of pharmaceutical products from a reservoir to an external receptacle, the supply tube comprising a conveying channel of substantially rectangular cross-section therealong formed within the supply tube, the conveying channel including a plurality of successively arranged adjoining sections, each section having:

first and second open ends on, and spaced from one another along, a central longitudinal plane that extends in the longitudinal direction of the supply tube, the second open end of each section adjoining the first open end of the next section, each pair of adjacent sections being alternately offset from one another on opposite sides of the plane; and first and second substantially straight portions extending from the first and second open ends, respectively, to adjoin one another at a juncture angled greater than 90°, each of the first and second portions being at an angle of less than 45° with respect to the longitudinal plane, such that each pharmaceutical product moves in a zig-zag multi-angled path as it is transferred through the conveying channel.

2. The supply tube of claim 1 wherein, from an axial perspective, the cross-sections of the sections are at an angle of up to 90° with the longitudinal plane.

3. The supply tube of claim 1 further including two shells joined at a joint face extending in the longitudinal direction of the supply tube, the shells each having a groove extending in the longitudinal direction in a non-linear manner, the grooves each forming a partial cross-section of the conveying channel.

4. The supply tube of claim 1 further including a core body and a cladding tube enclosing the core body, wherein the conveying channel in the core body is formed by a groove, the groove having a plurality of successively arranged adjoining sections, each pair of adjacent sections being alternately offset from one another on opposite sides of the longitudinal plane, and wherein the cladding tube laterally closes the groove.

5. A method of producing a supply tube having a conveying channel formed within the supply tube, the method comprising:

creating two half-shells by injection molding, the half-shells each having a groove that forms a partial cross-section of the conveying channel; and joining the two half-shells together at a joint face extending in a longitudinal direction of the supply tube, thereby forming the conveying channel of a substantially rectangular cross-section adapted for transferring, under the effect of gravity, ones of a plurality of pharmaceutical products from a reservoir to an external receptacle, the conveying channel including a plurality of successively arranged adjoining sections, each section having: first and second open ends on, and spaced from one another along, a central longitudinal plane that extends in the longitudinal direction of the supply tube, the second open end of each section adjoining the first open end of the next section, each pair of adjacent sections being alternately offset from one another on opposite sides of the plane; and first and second substantially straight portions extending from the first and second open ends, respectively, to adjoin one another at a juncture angled greater than 90°, each of the first and second portions being at an angle of less than 45° with respect to the longitudinal plane, such that each pharmaceutical product moves in a zig-zag multi-angled path as it is transferred through the conveying channel.

6. A method of producing a supply tube, the supply tube having a central longitudinal plane that extends in a longitudinal direction of the supply tube, comprising:

providing a longitudinal massive rod, a longitudinal rotating end mill and a longitudinal cladding tube;

penetrating the rod with the rotating end mill in a radial direction thereby forming a groove in the rod which is in parallel to the longitudinal plane;

moving the rod and the rotating end mill against each other in a longitudinal direction of the rod while rotating the rod in sections back and forth about up to 90° around the longitudinal plane; and enveloping the rod with the cladding tube, thereby producing a supply tube having a conveying channel of a substantially rectangular cross-section adapted for transferring, under the effect of gravity, ones of a plurality of pharmaceutical products from a reservoir to an external receptacle, wherein the conveying channel includes a plurality of successively arranged adjoining sections, each section having first and second open ends on, and spaced from one another along, a central longitudinal plane that extends in the longitudinal direction of the supply tube, the second open end of each section adjoining the first open end of the next section, each pair of adjacent sections being alternately offset from one another on opposite sides of the plane and first and second substantially straight portions extending from the first and second open ends, respectively, to adjoin one another at a juncture angled greater than 90°, each of the first and second portions being at an angle of less than 45° with respect to the longitudinal plane, such that each pharmaceutical product moves in a zig-zag multi-angled path as it is transferred through the conveying channel.

* * * * *